US005303491A

United States Patent [19]

Satoh et al.

[11] Patent Number: 5,303,491

[45] Date of Patent: * Apr. 19, 1994

[54] SIMULATED NOVELTY CONTAINER CAPABLE OF MOVEMENT

[75] Inventors: Yasuta Satoh; Yasuyuki Moriyama, both of Nagareyama; Hatsuo Ohkoshi, Narita; Masatoshi Sakurai; Yukihiro Asami, both of Tokyo, all of Japan

[73] Assignee: Takara Co., Ltd., Tokyo, Japan

[ * ] Notice: The portion of the term of this patent subsequent to Apr. 2, 2008 has been disclaimed.

[21] Appl. No.: 923,309

[22] Filed: Jul. 31, 1992

Related U.S. Application Data

[62] Division of Ser. No. 504,243, Apr. 4, 1990, Pat. No. 5,134,796.

[30] Foreign Application Priority Data

| | | | |
|---|---|---|---|
| Jun. 30, 1989 | [JP] | Japan | 1-78213 |
| Aug. 29, 1989 | [JP] | Japan | 1-222490 |
| Sep. 4, 1989 | [JP] | Japan | 1-103591 |
| Dec. 5, 1989 | [JP] | Japan | 1-315534 |
| Dec. 6, 1989 | [JP] | Japan | 1-317152 |
| Dec. 28, 1989 | [JP] | Japan | 1-344479 |
| Feb. 2, 1990 | [JP] | Japan | 2-13980 |

[51] Int. Cl.[5] ..... G09F 19/08

[52] U.S. Cl. ..... 40/414; 40/457; 446/74; 472/137

[58] Field of Search ..... 40/411, 414, 429, 457, 40/466, 470; 446/175, 330, 354, 74; 472/137

[56] References Cited

U.S. PATENT DOCUMENTS

| | | | |
|---|---|---|---|
| 1,261,300 | 4/1918 | Saxon . | |
| 2,875,538 | 8/1955 | Faville . | |
| 3,039,615 | 4/1961 | Uihlein . | |
| 3,119,201 | 1/1964 | Brown . | |
| 3,444,646 | 5/1969 | Domashovetz . | |
| 3,458,950 | 8/1969 | Tomaro . | |
| 3,486,260 | 12/1967 | Ward . | |
| 3,888,023 | 12/1969 | Genin . | |
| 4,097,917 | 6/1978 | McCaslin . | |
| 4,516,951 | 5/1985 | Saigo et al. . | |
| 4,545,775 | 10/1985 | Kim . | |
| 4,582,317 | 4/1986 | Provenzano, Jr. . | |
| 4,717,364 | 1/1988 | Furukawa . | |
| 4,765,079 | 8/1988 | Takahashi . | |
| 4,775,351 | 10/1988 | Provenzano . | |
| 4,775,352 | 10/1988 | Curran et al. . | |
| 4,795,395 | 1/1989 | Oishi et al. | 446/303 X |
| 4,810,227 | 3/1989 | Kim . | |
| 4,820,231 | 4/1989 | Mikitka et al. | 446/75 X |
| 4,828,530 | 5/1989 | Lee . | |
| 4,850,930 | 6/1989 | Sato et al. . | |
| 4,903,424 | 2/1990 | Satoh et al. . | |
| 4,923,428 | 5/1990 | Curran . | |
| 4,939,944 | 6/1990 | Hou . | |
| 4,943,256 | 7/1990 | Symons . | |
| 5,003,714 | 4/1991 | Satoh et al. . | |
| 5,134,796 | 8/1992 | Satoh et al. | 40/414 |

FOREIGN PATENT DOCUMENTS

| | | |
|---|---|---|
| 0036797 | 4/1981 | European Pat. Off. . |
| 0067052 | 12/1982 | European Pat. Off. . |
| 147496 | 2/1903 | Fed. Rep. of Germany . |
| 1305333 | 1/1973 | United Kingdom . |
| 0237083 | 7/1975 | United Kingdom . |
| 2186204 | 8/1987 | United Kingdom . |
| 2221401A | 2/1990 | United Kingdom . |

*Primary Examiner*—Brian K. Green
*Attorney, Agent, or Firm*—Price, Gess & Ubell

[57] ABSTRACT

A figure moving article capable of accomplishing unique and unexpected movement sufficient to exhibit unexpected movements. The figure moving article includes a cylindrical container having a peripheral wall formed of a flexible material. In the container is arranged a bending structure which is actuated to cause the container to carry out bending motion. Also, a motor is received in the container in a manner to be operatively connected to the bending structure to actuate the bending structure and a motor drive circuit for driving the motor is arranged in the container. The bending structure is operatively connected to the container so as to transmit the actuation of the bending structure to the container, resulting in the container exhibiting bending movement.

9 Claims, 10 Drawing Sheets

SIMULATED NOVELTY CONTAINER CAPABLE OF MOVEMENT

This is a divisional application of Ser. No. 07/504,243, filed on Apr. 4, 1990, which issued as U.S. Pat. No. 5,134,796 on Aug. 4, 1992.

BACKGROUND OF THE INVENTION

1. Field of the Invention

This invention relates to a figure moving article, and more particularly to a figure moving article which carries out a bending motion or movement to vary a figure such as a configuration, an appearance or the like in a unique and unexpected manner upon detection of external stimulus such as light, sound, infrared rays or the like.

2. Description of Related Art

A conventional figure moving article generally takes an appearance of a still life such as a flower or the like and is typically used for interior decoration. Such a conventional figure moving article is so constructed that when a sound sensor detects sound of a predetermined level such as the voice of a viewer talking to the article, hand clapping, background music or the like, a switching element is turned on to drive a motor through a power supply. The so-actuated motor causes a core element serving as an actuation member to be rotated, resulting in a cover member which has an appearance in imitation of, for example, a flower and in which the core element is loosely fitted being moved in a meandering manner with the rotation of the core element.

However, consumers desire the appearance of a figure moving article exhibiting unique and unexpected motion or movement which has never been seen.

Also, in the conventional figure moving article, the disappearance of sound to be detected by the sensor causes the driving of the motor to be immediately stopped, so that the movement of the article is obliged to be stopped on a posture unnatural to a figure of the article on the way of the movement. This suggests to a viewer the fact that the figure moving article which the viewer considers to be a still life carries out movement, to thereby cause the unexpectedness and originality of the figure moving article to be reduced.

Accordingly, it would be highly desirable to provide a figure moving article which is capable of accomplishing unique and unexpected movement sufficient to exhibit unexpected variation in figure.

SUMMARY OF THE INVENTION

Generally speaking, in accordance with one aspect of the present invention, a figure moving article is provided. The figure moving article includes a container formed of a flexible material; a bending structure received in the container and actuated to cause the container to carry out a bending motion; a motor received in the container and operatively connected to the bending structure to actuate the bending structure; and a motor drive circuit for driving said motor. The bending structure is operatively connected to the container so as to transmit the actuation of the bending structure to the container, resulting in the container exhibiting bending movement.

Also, in accordance with the present invention, a figure moving article is provided. The figure moving article includes a container formed of a flexible material into a cylindrical shape; a base; a motor mounted on the base; a motor drive circuit electrically connected to the motor to drive the motor; a rotation member operatively connected to the motor so as to be rotated with the driving of the motor; an oscillation member supported on the base in a manner to stand up and be pivotally movable and operatively connected to the rotation member so as to be pivotally moved depending upon the rotation of the rotation member; a support member arranged above the oscillation member is a manner to be movable in relation to the oscillation member and connected to the side wall of the container to transmit the pivotal movement of the oscillation member to the container, to thereby cause the container to carry out bending motion; a sensor for detecting external stimulus; a switching element connected between the sensor and the motor drive circuit so as to be actuated depending upon the external stimulus detected by the sensor; and a posture detecting switch for detecting a predetermined posture of the oscillation member. The posture detecting switch is connected to the switching element and motor drive circuit to cause the motor drive circuit to drive the motor when the switching element is turned off and unless the posture detecting switch detects the predetermined posture of the oscillation member. The figure moving article also includes a spring interposed between the oscillation member and the support member so as to exert elastic force in directions of separating the oscillation member and support member from each other. The container receives the above-described respective components therein.

Further, in accordance with the present invention, a figure moving article is provided. The figure moving article includes a container formed of a flexible material into a cylindrical shape; a base; a motor mounted on the base; a motor drive circuit electrically connected to the motor to drive the motor; a rotation member operatively connected to the motor so as to be rotated with the driving of the motor; an oscillation member supported on the base in a manner to stand up and be pivotally movable and operatively connected to the rotation member so as to be pivotally moved depending upon the rotation of the rotation member; a support member arranged above the oscillation member in a manner to be movable in relation to the oscillation member and connected to the side wall of the container to transmit the pivotal movement of the oscillation member to the container to thereby cause the container to carry out a bending motion; a ball joint for operatively connecting the oscillation member and support member to each other therethrough; a sensor for detecting external stimulus; and a spring interposed between the oscillation member and the support member so as to exert elastic force in directions of separating the oscillation member and support member from each other. The container receives the above-described respective components therein.

In accordance with another aspect of the present invention, a motor drive circuit for a figure moving article which is adapted to carry out a bending movement utilizing driving of a motor arranged therein and including a drive coil is provided. The motor drive circuit includes a motor-drive switching element for supplying electric power from a power supply to the motor; a short-circuit switching element for short-circuiting the drive coil of the motor; a sensor for detecting external stimulus; a posture detecting switch for detecting a predetermined posture of the figure moving article; and a selection circuit for turning on the motor-drive switching element to drive the motor when the sensor detects the external stimulus and for turning off the motor-drive switching element and turning on the short-circuit switching element to cause the drive coil of the motor to be discharged when the posture detecting switch detects the predetermined posture of the figure moving article.

Accordingly, it is an object of the present invention to provide a figure moving article which is capable of permitting a figure thereof to accomplish unique and unexpected movement upon detection of external stimulus as well as be kept stationary when it does not detect the stimulus.

It is another object of the present invention to provide a figure moving article which is capable of permitting a figure thereof to carry out bending motion, resulting in a viewer taking much interest and surprise.

It is a further object of the present invention to provide a figure moving article which is capable of taking a regular posture natural to a figure thereof whenever the movement of the article is stopped.

It is still another object of the present invention to provide a figure moving article which is capable of exhibiting satisfactory serviceability.

It is yet another object of the present invention to provide a figure moving article which is capable of being prevented from being damaged due to repeated bending motion for a long period of time.

It is even another object of the present invention to provide a figure moving article which is capable of increasing the amount of movement of a figure thereof.

It is a still further object of the present invention to provide a figure moving article which is capable of stopping bending movement at a posture natural to a figure of the article.

It is an even further object of the present invention to provide a motor drive circuit for a figure moving article which is capable of causing the movement of the figure moving article to be constantly stopped at a predetermined posture with accuracy.

It is a yet further object of the present invention to provide a motor drive circuit for a figure moving article which is capable of causing a motor to act as a brake when the driving of the motor is stopped, to thereby accomplish the stopping of driving of the motor with high accuracy.

Still other objects and advantages of the invention will in part be obvious and will in part be apparent from the specification.

The invention accordingly comprises the features of construction, combination of elements, an arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENTS

Now, a figure moving article according to the present invention will be described hereinafter with reference to the accompanying drawings.

Figure 1:
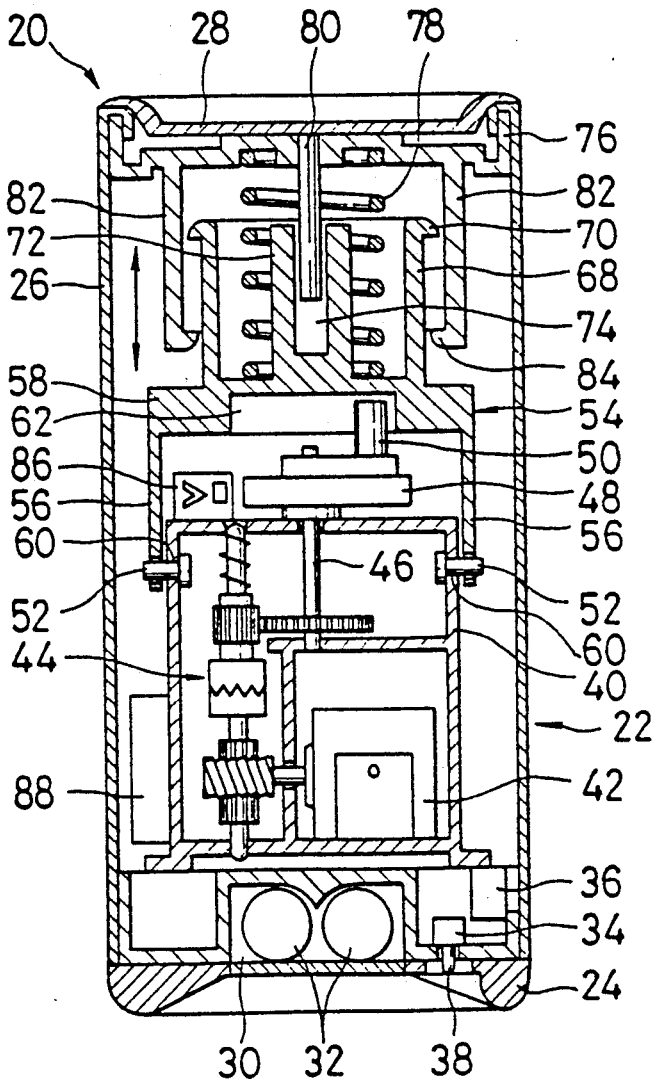
FIG. 1 is a vertical sectional view showing an embodiment of a figure moving article according to the present invention.
Figure 2:
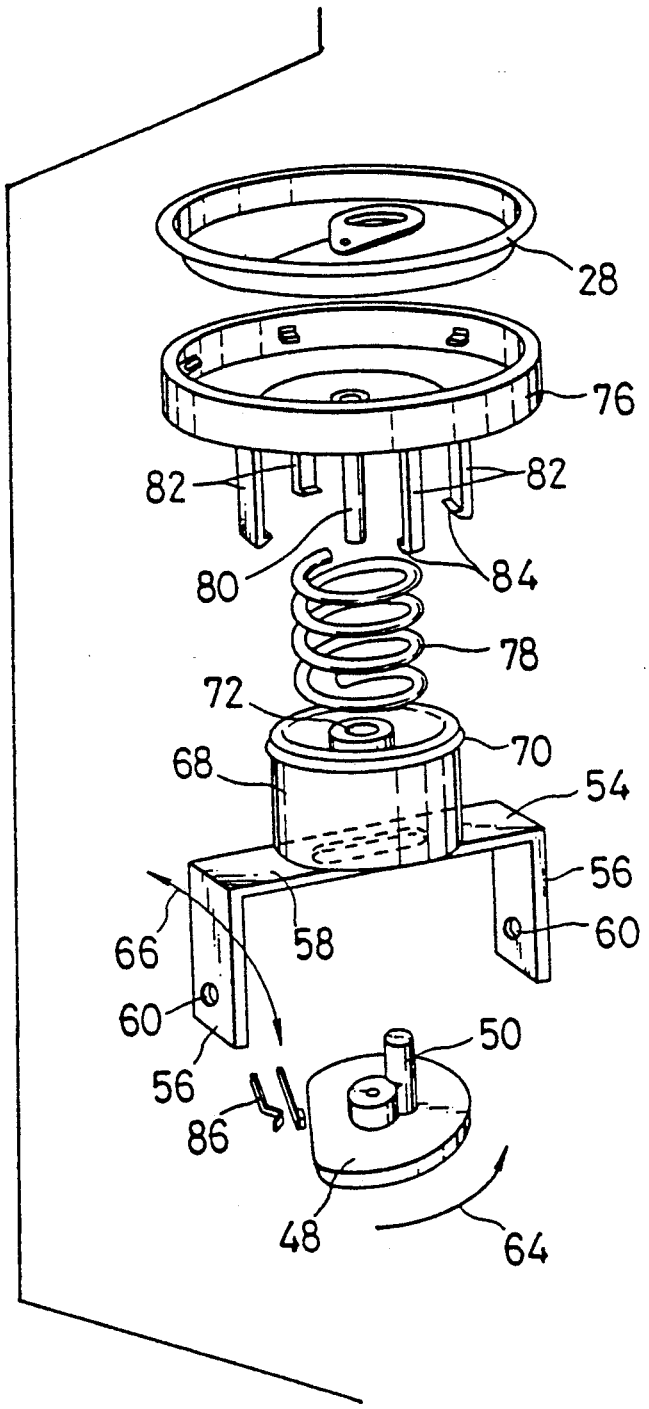
FIG. 2 is an exploded perspective view showing a bending structure incorporated in the figure moving article shown in FIG. 1.

FIGS. 1 to 3 illustrate an embodiment of a figure moving article according to the present invention.

A figure moving article of the illustrated embodiment generally designated at reference numeral 20 includes an envelope or container 22 formed into a cylindrical shape. In the illustrated embodiment, the container 22 may be formed in imitation of a beer can. The container 22 includes a bottom 24, a peripheral wall or barrel 26 and a top 28. In the container 22 is arranged a receptacle 30 in which a power supply 32 such as a dry cell or the like is received. The receptacle 30 is placed on the bottom 24 of the container 22 so as to replaceably receive the power supply 32 therein. For this purpose, the bottom 24 is formed so that a part thereof may be openable. Also, on the bottom 24 are mounted a main switch 34 and a sound sensor 36 constituting a motor drive circuit described hereinafter. The main switch 34 includes an operation lever 38 arranged in a manner to outward project through the bottom 24, through which the main switch 34 is operated for actuation of the figure moving article.

Also, in the container 22 is securely mounted a box-like casing 40, which is arranged on the receptacle 30. In the illustrated embodiment, the casing 40 may be considered to constitute a base. In the casing 40 are received a motor 42 and a reduction gear mechanism 44 including a spur gear, a reduction gear comprising a worm and a worm gear, and an over-load cutout friction clutch. The gear mechanism 44 also includes an output shaft 46 arranged so as to upward extend through the top wall of the casing 40. On the portion of the output shaft 46 projecting from the casing 40 is mounted a cam 48 acting as a rotation member, which is provided on the upper surface thereof with an eccentric drive pin 50 in a manner to upward extend therefrom. The casing 40 is provided on both sides of the upper portion of the side wall thereof with fixing pins 52 outward extending through the casing 40. Above the casing 40 is arranged an oscillation member 54, which includes a pair of leg portions 56 arranged so as to straddle the upper portion of the casing 40 and a connection portion 58 extending between the leg portions 56. The leg portions 56 each are formed at the lower portion thereof with a through-hole 60 through which each of the fixing pins 52 is loosely inserted, so that the oscillation member 54 may be pivotally moved about the fixing pins 52 with respect to the casing 40. The connection portion 58 is formed on the lower surface thereof with an elongated recess 62 so as to extend in the longitudinal direction thereof, in which the above-described eccentric drive pin 52 of the cam 48 is received.

In such arrangement of the cam 48 and oscillation member 54, the rotation of the cam 48 in a direction indicated at an arrow 64 in FIG. 2 causes the oscillation member 54 to be pivotally moved about the fixing pins 52 in directions indicated at arrows 66. The oscillation member 54 is provided thereon with a cylindrical member 68. In the illustrated embodiment, the cylindrical member 68 is formed integral with the member 54 in a manner to be placed on the oscillation member 54. The cylindrical member 68 is provided on the outer periphery of the upper portion thereof with an annular projection 70 laterally extending therefrom. In the cylindrical member 68 is arranged a projection 72 in a manner to be substantially concentric with the member 68 and extend in the axial direction of the member 68. Projection 72 includes a hole 74 open at the upper surface of the member 68 and extending in the axial direction thereof.

Further, in the container 22 is fittedly arranged a support member 76 in the form of a cover in a manner to be positioned between the top 28 and the oscillation member 54. The support member 76 is adapted to be engaged with the container 22 to support it and transmit the actuation of the support member 76 to the container as described below. In the illustrated embodiment, it is engaged with the side wall or peripheral wall 26 of the container 22 and, for this purpose, it is formed into a circular shape of substantially the same diameter as the peripheral wall 26 of the container 22. Thus, the support member 76 is engaged at the overall periphery thereof with the side wall 26 of the container 22. Between the support member 76 and the oscillation member 54 is interposed a coiled spring 78 in such a manner that a part thereof is received in the cylindrical member 68 and fitted on the projection 72, resulting in constantly urging the support member 76 and the oscillation member 54 in directions of separating them from each other. The support member 76 is provided at the central portion of the lower surface thereof with a guide pin 80 downward extending therefrom so as to be inserted into the blind hole 74 of the projection 72. Also, the support member 76 is provided on a lower surface thereof with a plurality of elongated projections 82, which extend downward therefrom and which are annularly spaced from each other so as to surround the cylindrical member 68. The projections 82 each are formed at the distal end thereof with a claw 84 in a manner to inward project therefrom which is adapted to be engaged with the annular projection 70 of the cylindrical member 68, so that the support member 76 constantly upward urged by the coiled spring 78 may be prevented from being released or disengaged from the cylindrical member 68. Thus, it will be noted that the support member 76 is arranged in a manner to be elastically movable with respect to the oscillation member 54 while holding the engagement with the member 54.

Thus, a bending structure is provided which is actuated by the motor and transmits the actuation of the bending structure to the container to cause it to carry out bending movement or motion.

For this purpose, the container 22 is formed so as to exhibit flexibility. In the illustrated embodiment, the peripheral wall or barrel 26 of the container 22 is adapted to exhibit it. The barrel 26 may be formed of a flexible material such as a flexible plastic sheet. The so-formed barrel 26 is engagedly connected to the support member 76 by adhesion or bonding in a manner to somewhat compress the coiled spring 78, resulting in the figure mounting article 20 of the illustrated embodiment normally exhibiting such an appearance as shown in FIG. 1 because the container is under tension. In the illustrated embodiment, the upper end of the barrel 26 is inward bent so as to be positioned inside the cover member 76 and the top 28 is securely put on the barrel 26.

Figures 3A, 3B, 3C:
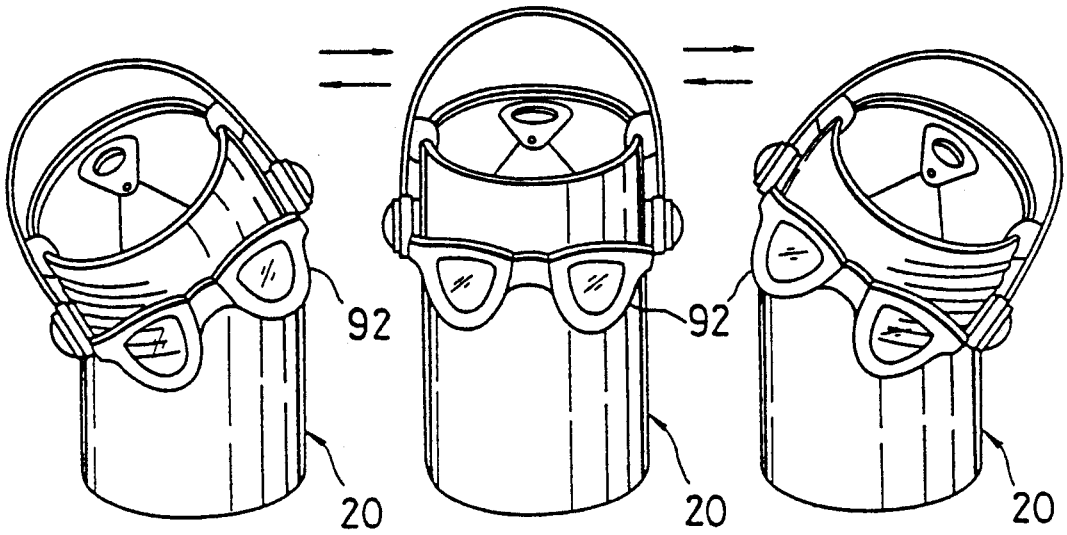
FIGS. 3A to 3C each are a schematic perspective view showing the manner of bending movement of the figure moving article shown in FIG. 1.

The figure moving article 20 of the illustrated embodiment may include a posture detecting switch 86 which constitutes a part of the motor drive circuit and is provided on the casing 40 for detecting a predetermined posture of the figure moving article. In the illustrated embodiment, the switch 86 is arranged on the outer surface of the casing 40 in a manner to be opposite to the outer periphery of the cam 48. In the illustrated embodiment, the posture detecting switch 86 is adapted to detect the angle of inclination of the bending structure and therefore the figure moving article 20. More particularly, the switch 86 is arranged so as to turn on when the article 20 is in bent postures as shown in FIGS. 3B and 3C other than an erect position as shown in FIGS. 1 and 3A and turn off when it is in the erect position. Designated at reference numeral 88 is a drive circuit body forming a part of the motor drive circuit.

Figure 4:
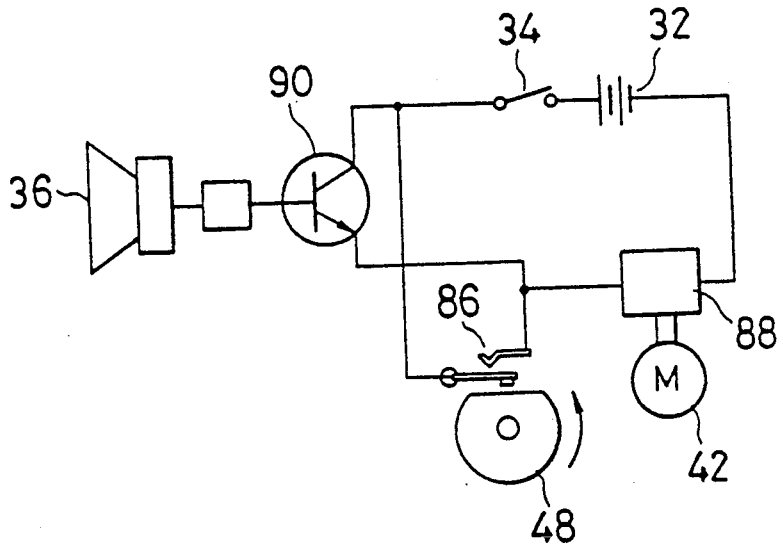
FIG. 4 is a circuit diagram showing a motor drive circuit incorporated in the figure moving article shown in FIG. 1.

FIG. 4 shows the motor drive circuit for driving the motor 42, wherein reference numeral 90 designates a switching element adapted to be turned on depending upon the output of the sound sensor or microphone 36. The switching element 90 is connected in series to the drive circuit body 88, power supply 32 and main switch 34.

Now, the manner of operation of the figure moving article of the illustrated embodiment constructed as described above will be described hereinafter with reference to FIGS. 1 to 5.

The figure moving article having a figure formed in imitation of a beer can is caused to be in such an erect or normal posture as shown in FIG. 3A whenever the main switch 34 is turned on through the operation lever 38. When the sound sensor or microphone 36 detects sound of a predetermined level or more such as hand clapping, music, voice talking to the article or the like after the main switch 34 is turned on, the switching element 90 turns on or off depending upon the magnitude or volume of the sound to cause electric power to be supplied from the power supply 32 to the motor drive circuit 88. This causes the motor 42 to be driven to rotate the rotation member or cam 48 through the gear mechanism 44, leading to rotation of the drive pin 50 in the recess 62, so that the oscillation member 54 may be pivotally moved about the support pins 52. This results in the figure moving article or beer can 20 being deformed in one direction or from the erect position shown in FIG. 3A to a bent position or posture shown in FIG. 3B or 3C, returned to the erect position shown in FIG. 3A and then deformed in the opposite direction or from the erect position to the bent position shown in FIG. 3C or 3B. Such bending motion of the article or can 20 is continued while the sound is continuously detected.

In the case that the posture of the figure moving article or beer can 20 is erect when the detection of the sound is interrupted, the posture detecting switch 86 is kept turned off, so that the supply of electric power from the power supply 32 to the drive circuit body 88, resulting in the movement of the can 20 being stopped. On the contrary, in the case that the beer can 20 is in the bent posture when the detection of the sound is interrupted, the posture detecting switch 86 is kept turned on until the oscillation member 54 is pivotally moved to the predetermined posture or erect position even when the switching element 30 turns off, so that the beer can 20 may be moved to the erect position shown in FIG. 3A, at which the movement of the can is stopped. This results in the barrel 26 of the figure moving article or can 20 being placed under tension to cause a configuration or appearance natural to a beer can to be kept.

Figure 5:
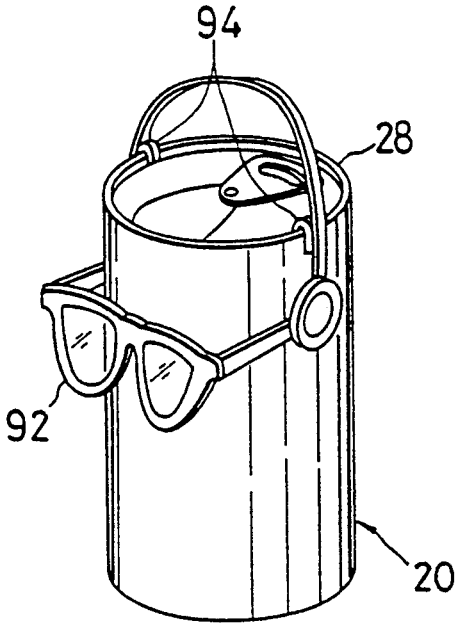
FIG. 5 is a perspective view of the figure moving article shown in FIG. 1 to which accessories are attached.

In the figure moving article or beer can of the illustrated embodiment, reference numeral 92 designates accessories formed in imitation of a glass and a headphone, which are detachably mounted on the outer periphery of the top 28 by means of holders 94, as shown in FIG. 5.

Figure 6:
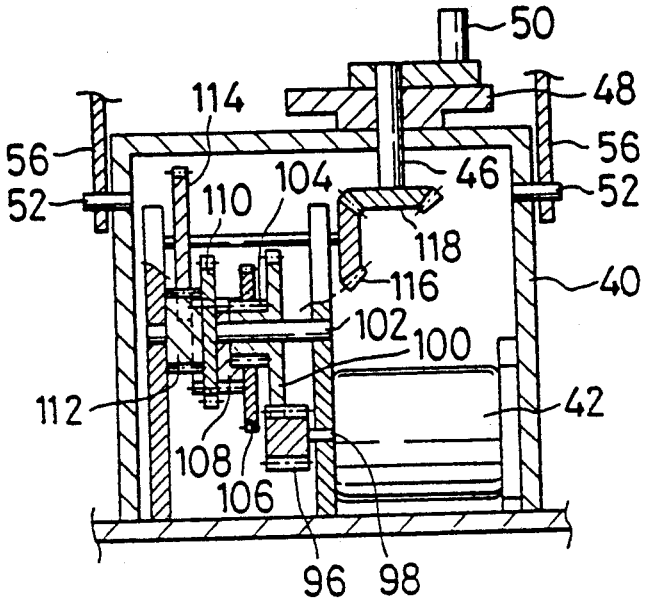
FIG. 6 is a fragmentary schematic view partly in section showing a modification of a reduction gear mechanism arranged between a motor and a bending structure in the figure moving article shown in FIG. 1.
Figure 7:
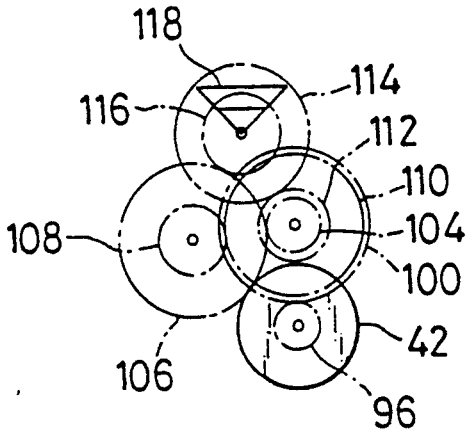
FIG. 7 is a schematic diagrammatic view of the gear mechanism shown in FIG. 6.

FIGS. 6 and 7 show a modification of the gear mechanism 44 incorporated in the figure moving article 20 of the illustrated embodiment. A gear mechanism 44 shown in FIGS. 6 and 7 includes a pinion 96 mounted on an output shaft 98 of the motor 42, a gear 100 mounted on a support shaft 102 and engaged with the pinion 96, a gear 104 provided integral with and coaxial with the gear 100, a gear 106 engaged with the gear 104, a gear 108 formed integral with the gear 106, a gear 110 engaged with the gear 108, a gear 112 provided integral with the gear 110, a gear 114 engaged with the gear 112, a bevel gear 116 rotated with the gear 114, and a bevel gear 118 mounted on an output shaft 46 of the mechanism 44. When the motor 42 is driven, the rotation of the motor 42 is transmitted through the so-constructed gear mechanism 44 to the output shaft 46 to rotate the cam 48, resulting in the drive pin 50 being eccentrically rotated. This results in the oscillation member 54 being pivotally moved, leading to actuation of the posture detecting switch 86.

The figure moving article of the illustrated embodiment is adapted to detect sound, however, a sensor for detecting external stimulus other than sound such as static electricity, light, pressure, infrared rays, smell, temperature or the like. For example, a pressure sensor may be used which is adapted to detect the weigh of a person approaching the figure moving article. Also, the figure moving article of the embodiment is made so as to have a figure in imitation of a beer can, however, it may be formed in imitation of a doll, a bottle, a monstrous beast or the like.

As can be seen from the foregoing, the figure moving article of the illustrated embodiment is constructed so as to be kept stationary when the sensor does not detect external stimulus, resulting in exhibiting a stationary configuration and/or appearance of a still life. When the article detects external stimulus, it carries out deformation or bending motion, to thereby cause a viewer to take much interest and surprise and any communication to be possibly created between the viewer and the article. Also, the arrangement of the posture detecting switch in the article permits the article to be kept at a regular posture inherent to a still life which the article imitates whenever the article does not detect external stimulus, because it causes the barrel to be kept erect and elastically stretched.

Figure 8:
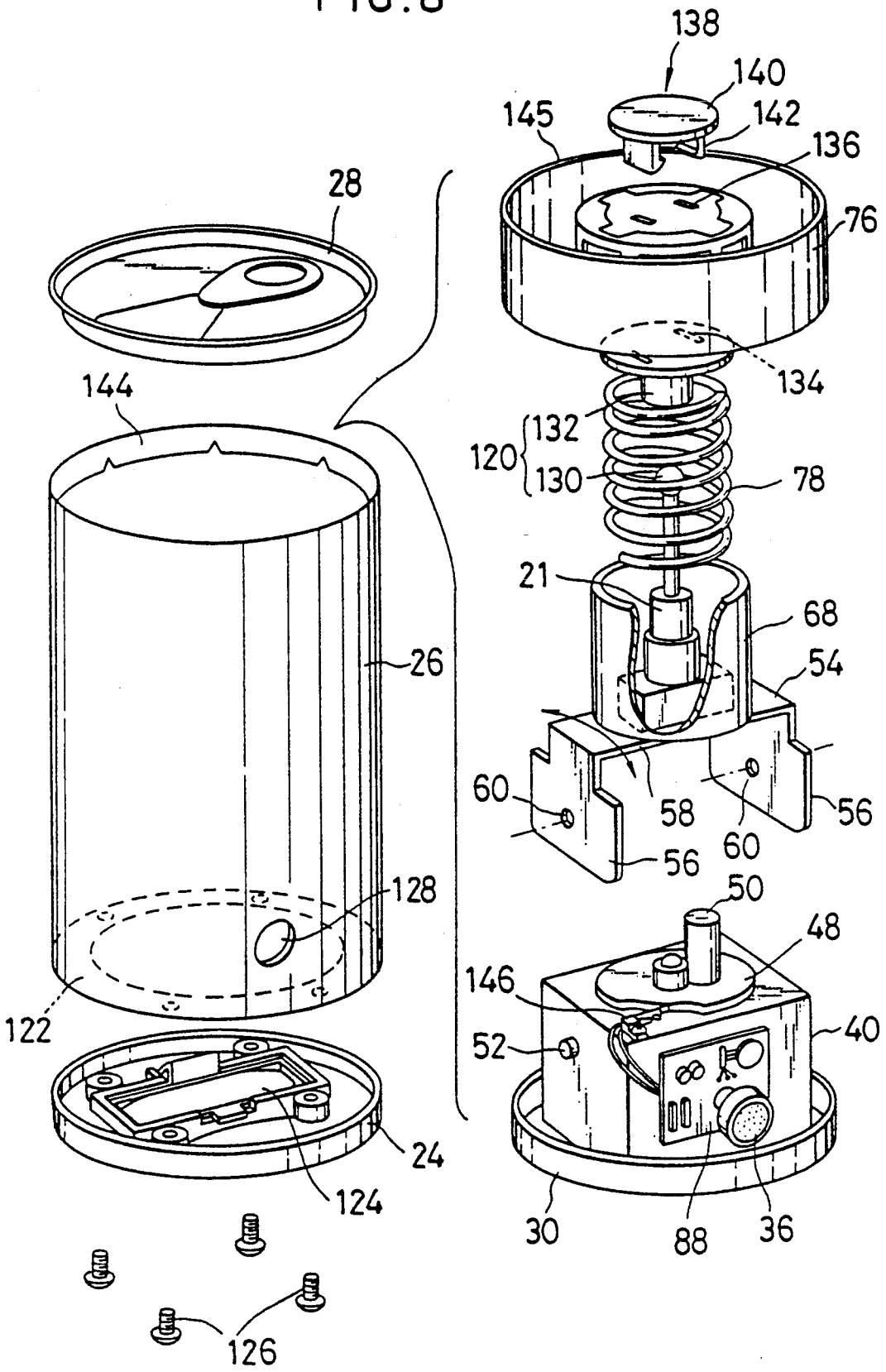
FIG. 8 is an exploded perspective view showing another embodiment of a figure moving article according to the present invention.
Figure 9:
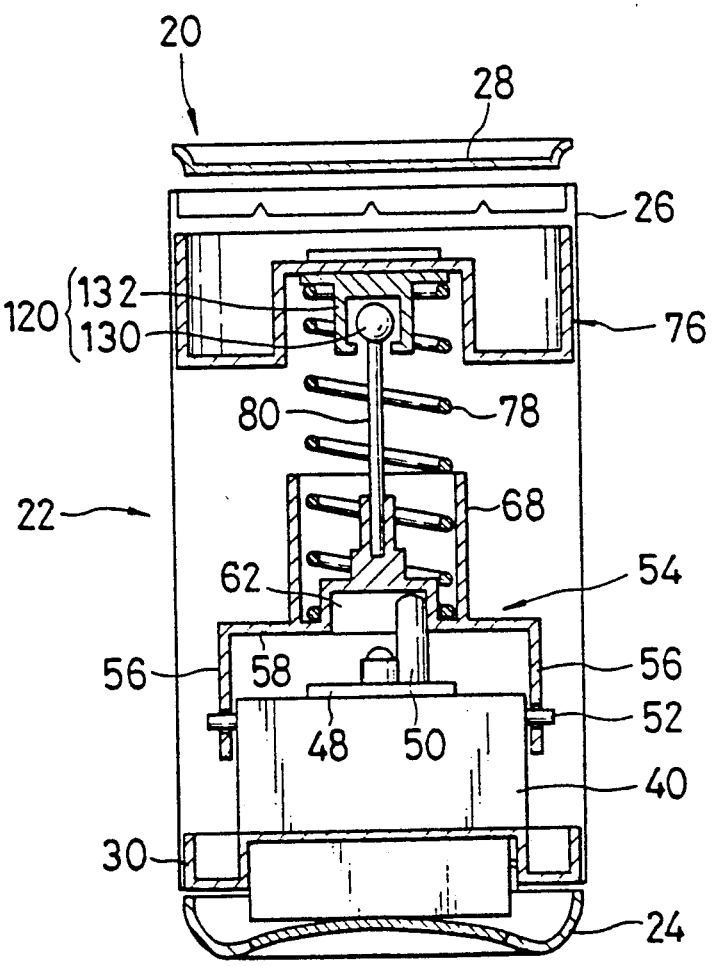
FIG. 9 is a vertical sectional view of the figure moving article shown in FIG. 8.

FIGS. 8 to 10 show another embodiment of a figure moving article according to the present invention.

A figure moving article of the illustrated embodiment is constructed so as to more smoothly exhibit bending motion.

In the embodiment described above with reference to FIGS. 1 to 7, the support member is apt to apply excessive or immoderate tension or force to the peripheral or side wall of the container, so that there is a possibility that the side wall is subject to irreversible stretch, resulting in sagging, because it is made of a flexible material. Also, this causes the separation of the container from the support member or the breakage of the container. Also, the arrangement of the spring between the support member and the oscillation member often fails to sufficiently transmit the pivotal movement of the oscillation member to the support member, to leading to a failure in an increase in the amount of movement of the figure moving article.

In the figure moving article shown in FIGS. 8 to 10, the connection between an oscillation member and a support member is improved to prevent unreasonable tension or force from being applied to a container and ensure natural movement of the support member to improve the serviceability, as well as satisfactorily transmit the pivotal movement of the oscillation member to the support member to increase the amount of movement of the figure.

The figure moving article of the illustrated embodiment includes a container 22 formed in imitation of a beer can and comprising a bottom 24, a peripheral or side wall 26 made of a flexible material such as a flexible vinyl resin sheet and a top 28. In the container 22 are arranged a casing 40 serving as a base, an oscillation member 54, a coiled spring 78 and a support member 76 of a substantially cylindrical shape, which may be arranged in substantially the same manner as those in the embodiment described above. Between the oscillation member 54 and the support member 76 is arranged a ball joint 120 for operatively connecting both to each other.

In the container 22 is arranged a receptacle 30 in which a power supply (not shown) such as a dry cell or the like is received. The receptacle 30 is placed on the bottom 24 of the container 22 so as to replaceably receive the power supply 32 therein. For this purpose, the peripheral wall 26 of the container 22 is inward bent at the lower end thereof to form an inward flange 122 on which the receptacle 30 is placed and the bottom 24 is formed so that a part 124 thereof may be openable. The receptacle is fixed on the flange 122 by means of screws 126 inserted through the bottom 24. In the illustrated embodiment, the receptacle 30 may be formed integral with the casing 40.

On the casing 40 is mounted a sensor 36 which is adapted to detect external stimulus such as light, sound, infrared rays or the like to actuate a switching element (not shown) for a drive circuit body 88 arranged substantially in the casing 40. The sensor 36 is externally projected through a through-hole 128 when the casing 40 is positioned in the container 22. Also, in the casing 40 are arranged a motor (not shown) driven when electric power is supplied from the power supply through the switching element thereto, a reduction gear mechanism (not shown) operatively connected to the motor and including an output shaft (not shown) on which a rotation member or cam 48 is mounted. Reference numeral 52 designates support pins outward projected through the casing 40. Such components may be constructed in substantially the same manner as those in the above-described embodiment. The rotation member or cam 48 includes an eccentric drive pin 50.

The oscillation member 54 includes a pair of leg portions 56 and a connection portion 58 interposed between the leg portions 56 so as to connect both together. On the connection portion 58 is arranged a cylindrical member 68 serving as a spring receiver. The connection portion 58 is formed on the lower surface thereof with an elongated recess 62 in a manner to be positioned in the cylindrical member 68. The leg portions 56 each are formed with a through-hole 60 through which the support pin 52 is fitted to support the oscillation member 54 on the casing or base 40 in a manner to be pivotally movable about the support pins 52. In the recess 62 is fitted the eccentric drive pin 50 of the cam 48, so that the rotation of the rotation member or cam 48 causes the oscillation member 54 to be pivotally moved about the support pins 52.

The ball joint 120 briefly described above comprises a ball 130 provided at one of the oscillation member 54 and connection member 76 and a ball socket 132 provided at the other of the members 54 and 76. In the illustrated embodiment, the ball 130 is arranged at the oscillation member 54 and the ball socket 132 is arranged at the support member 76. More particularly, the ball 130 is mounted on the distal end of a support pin 80 fixed at the proximal end thereof on the central portion of the bottom of the cylindrical member or spring receiver 68 so as to upward extend therefrom and the ball socket 132 is mounted on the central portion of the lower surface of the support member 76. The ball socket 132 is formed on the upper surface thereof with a plurality of holding holes 134 and the support member 76 is formed with a plurality of through-holes 136 in a manner to positional correspond to the holding holes 134. Reference numeral 138 designates a fixture which includes a flat support section 140 and a plurality of claws or clicks 142 provided on the lower surface of the support section 140 so as to downward extend therefrom and fixedly inserted through the holes 134 and 136, to thereby fix the ball socket 132 with respect to the support member 76.

Between the support member 76 and the oscillation member 54 is interposed the coiled spring 78 for constantly urging both members 76 and 54 in directions of separating them from each other. The coiled spring 78 is so arranged that its lower portion is received in the cylindrical member or spring receiver 68 and its upper portion is fitted on the ball socket 132.

Thus, a bending structure is formed which serves to transmit the output of the motor therethrough to the side wall 26 of the container 22.

In the bending structure constructed as described above, the coiled spring 78 is received at the lower portion thereof in the spring receiver 68 and then the ball 130 of the ball joint 120 is forcedly placed in the ball socket 132 mounted on the lower surface of the support member 76, to thereby connect the oscillation member 54 and support member 76 to each other and pressedly abut the upper end of the coiled spring 78 against the lower surface of the support member 76.

The so-assembled bending structure is then inserted into the container while being integrally connected between the casing or base 40 and the support member 76. Then, the base 40 is fixed with respect to the container 22. The peripheral wall 26 of the container 22 is inward folded down at the upper end thereof as indicated at reference numeral 144 so that the folded upper end may securely enclose the upper end 145 of the annular support member 76. Thereafter, the top 28 is fitted in the support member 76, resulting in the container being rigidly connected to the support member 76 while being kept erect.

In the embodiment shown in FIGS. 8 and 9, the rotation member 48 comprises a cam as described above, and a micro switch 146 is arranged in proximity to the cam 48 and connected to the drive circuit body 88 in parallel with the switching element connected to the sensor 36, resulting in a posture restoring mechanism being constructed which serves to drive the motor to restore the figure moving article to the normal erect posture even if it does not detect external stimulus at the time when it is in a bent posture.

Figures 10A, 10B, 10C:
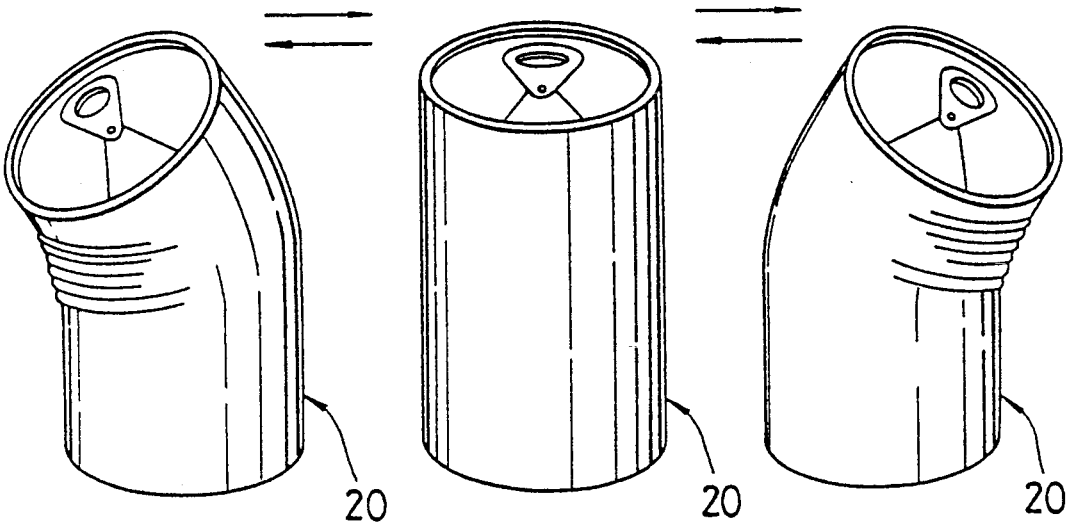
FIGS. 10A to 10C each are a schematic perspective view showing the manner of bending movement of the figure moving article shown in FIG. 8.

In the figure moving article of FIGS. 8 and 9 constructed as described above, when the sensor detects external stimulus such as sound, light, infrared rays, smell, heat or the like, it actuates to turn on the switching element to drive the motor. This results in the rotation member 48 being rotated, leading to pivotal movement of the oscillation member 54, which is transmitted through the ball joint 120 to the support member 76. This causes the container 22 and more specifically the peripheral wall 26 of the container 22 to repeatedly carry out bending motion, as shown in FIGS. 10A to 10C. During the bending motion, one side of the peripheral wall 26 is repeatedly subject to contraction and expansion, whereas the other side is repeatedly subject to expansion and contraction corresponding to the movement of the one side, respectively. Accordingly, the reaction of the contraction is repeatedly applied to the support member 76, however, the ball joint suitably pivotally moves, to thereby prevent excessive force from being applied to the peripheral wall 26 of the container 22, so that the support member 76 may properly determine the range of movement in which it pivotally moves in a natural posture. This effectively prevents damage of the container 22 and particularly the peripheral wall 26 irrespective of the repeated bending movement of the container 22.

Further, when the oscillation member 54 is returned to an erect position, the coiled spring 78 causes the support member 76 to be forcedly upward separated from the oscillation member 54, so that the figure moving article may be restored to the erect position while being kept stretched.

The arrangement of the posture restoring mechanism comprising, in the illustrated embodiment, the rotation member 48 and micro switch 146 causes the driving of the motor to be continued until the figure moving article is restored to the erect position even when external stimulus is extinguished on the way of the bending motion. Thus, a viewer would not imagine the bending motion of the figure moving article from the stationary posture of the article, so that the bending motion of the article carried out in response to external stimulus causes the viewer to take much surprise.

As can be seen from the foregoing, the figure moving article shown in FIGS. 8 and 9 is so constructed that the ball joint is interposedly arranged between the oscillation member and the support member and the spring is likewise interposed between both members to urge the members in directions of separating them from each other. Such construction permits the support member to readily carry out positional variation and effectively prevents unreasonable or excessive force from being applied to the peripheral wall of the container with the pivotal movement of the oscillation member, so that the figure moving article may carry out smooth bending motion without causing any deterioration, damage and separation of the peripheral wall.

The remaining part of the embodiment of FIGS. 8 and 9 may be constructed in substantially the same manner as that shown in FIGS. 1 to 7.

Figure 11:
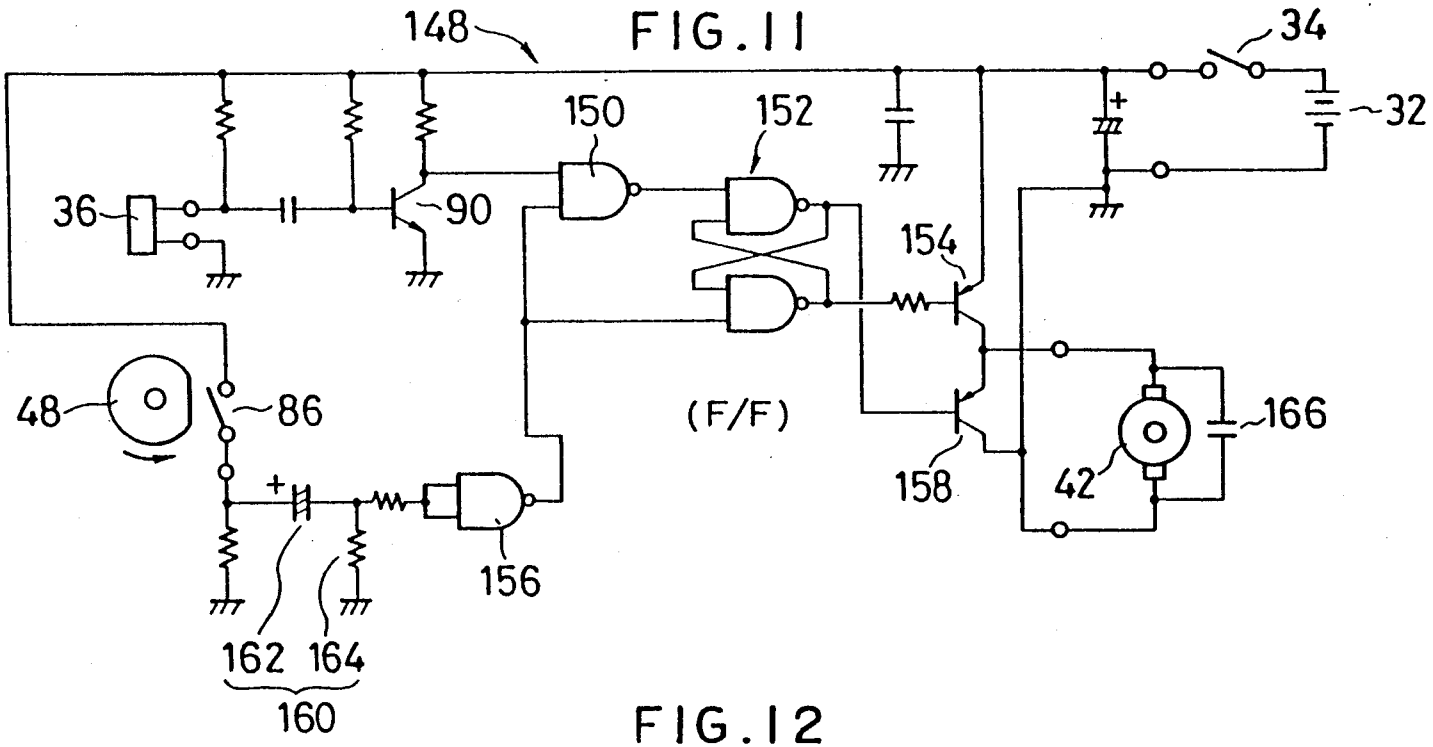
FIG. 11 is a circuit diagram showing another motor drive circuit suitable for use for a figure moving article according to the present invention.

The motor drive circuit suitable for use for each of the above-described embodiments may be constructed as shown in FIG. 11. A motor drive circuit generally indicated at reference numeral 148 in FIG. 11 is adapted to cause a motor to also act as a brake when the movement of the motor is stopped due to disappearance of external stimulus to be detected by a sensor, so that the figure moving article of the present invention may be stopped at a predetermined posture and particularly a posture natural to a still life in which the figure moving article originates with high accuracy to enhance the accuracy of movement of the figure moving article.

For this purpose, the motor drive circuit 148 includes a sound sensor or microphone 36 which is adapted to generate an output signal upon detection of sound of a predetermined level or more, which is then supplied through a switching element 90 comprising an NPN-type transistor to one terminal of a first NAND circuit 150. Reference numeral 152 designates a selection circuit, which may be a well-known flip-flop circuit comprising two NAND circuits crossedly connected to each other. The flip-flop circuit 152 uses a signal supplied thereto from the NAND circuit 150 as a start signal to turn on a motor-drive switching element 154 and uses a signal supplied thereto from a second NAND circuit 156 described hereinafter as a reset signal to turn on a short-circuit switching element 158. Thus, the flip-flop circuit 152 acts to selectively actuate the switching elements 154 and 158.

The second NAND circuit 156 is supplied thereto through a prohibition circuit 160 a signal generated from a posture detecting switch 86 actuated by the rotation member or cam 48 rotated in synchronism with the motor 42. The prohibition circuit 160 may be a well-known differentiating circuit comprising a capacitor 162 and a resistor 164, and the output of the NAND circuit 156 is delayed by time corresponding to a time constant of the prohibition circuit 160 with respect to the signal from the posture detecting switch 86. In other words, for such a period of time, the flip-flop circuit 152 acts to prohibit a reverse action even when the NAND circuit 150 supplies a signal to the flip-flop circuit 152. Both switching elements 154 and 158 each may comprise a PNP-type transistor, of which the bases are connected to output terminals of the two NAND circuits constituting the flip-flop circuit or selection circuit 152, respectively.

The collector and emitter of switching element 154 acting as a motor-drive are connected to a line for supplying electric power from the power supply 32 to the motor 42, so that when a signal is supplied from the flip-flop circuit 152 to the motor-drive switching element 154, the element 154 drives the motor 42. The collector and emitter of the switching element 158 acting as a short-circuit switching element are connected to both terminals of a capacitor 166 connected in parallel with a drive coil of the motor 42. Thus, when a signal is supplied from the flip-flop circuit 152 to the base of the short-circuit switching element 158, it causes the drive coil of the motor 42 to be short-circuited to discharge the drive coil, resulting in braking of the motor 42.

Figure 12:
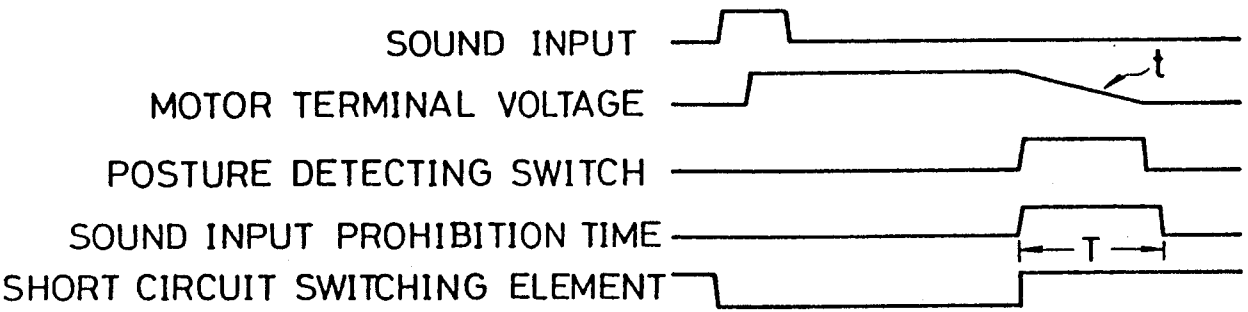
FIG. 12 is a wave form chart showing the operation of the motor drive circuit of FIG. 11.

Now, the manner of operation of the motor drive circuit constructed as described above will be described hereinafter with reference to FIGS. 11 and 12.

When the sound sensor or microphone 36 detects sound of a predetermined level or more while the main switch 34 is kept turned on, the NAND circuit 150 causes the flip-flop circuit 152 to be actuated. The actuated flip-flop circuit 152 then actuates the motor-drive switching element 154, resulting in the motor 42 being driven. The driving of the motor 42 causes the rotation member or cam 48 to be rotated to turn on the posture detecting switch 86. This indicates that the figure moving article of the present invention reaches a predetermined posture such as an erect posture, accordingly, it is required to stop the motor 42 at this time. When the posture detecting switch 86 is thus turned on, the second NAND circuit 156 causes the output of the switch 86 to be reversed for a period of time corresponding to a time constant T. This causes the flip-flop circuit 152 to interrupt the actuation of the motor-drive switching element 154 to turn on the short-circuit switching element 158. The turning-on of the short-circuit switching element 158 causes the drive coil of the motor 42 to be discharged, so that the motor 42 is subject to braking, resulting in being stopped.

Thus, the motor 42 acts as a brake when the figure moving article reaches a predetermined posture, so that it may stop the movement of the article at the predetermined posture constantly, even when there is a variation in moment of inertia of the figure moving article or even when load applied from the peripheral wall of the container of the figure moving article to the motor is varied due to a variation in flexibility of the peripheral wall of the figure moving article caused by a variation in ambient temperature.

The time constant T which is a reverse time of the NAND circuit 156 is set to be longer than time of from the start of turning-off of the motor a decrease in terminal voltage of the motor 42 to zero. During the reverse time of the second NAND circuit 156, the flip-flop circuit 152 keeps the motor 42 stopped even when the output of the sound sensor or microphone 36 is supplied to the first NAND circuit 150. Accordingly, the bending movement of the figure moving article is temporarily stopped at such an erect posture as shown in FIG. 3A or 10A although the sensor successively detects sound, resulting in the bending motion of the article while exhibiting satisfactory modulation.

In the motor drive circuit of FIG. 11, a sound sensor is used as the sensor 36. However, a sensor which detects external stimulus other than sound such as light, infrared rays, temperature, pressure, static electricity, small, smoke or the like may be suitably used for this purpose.

Figure 13:
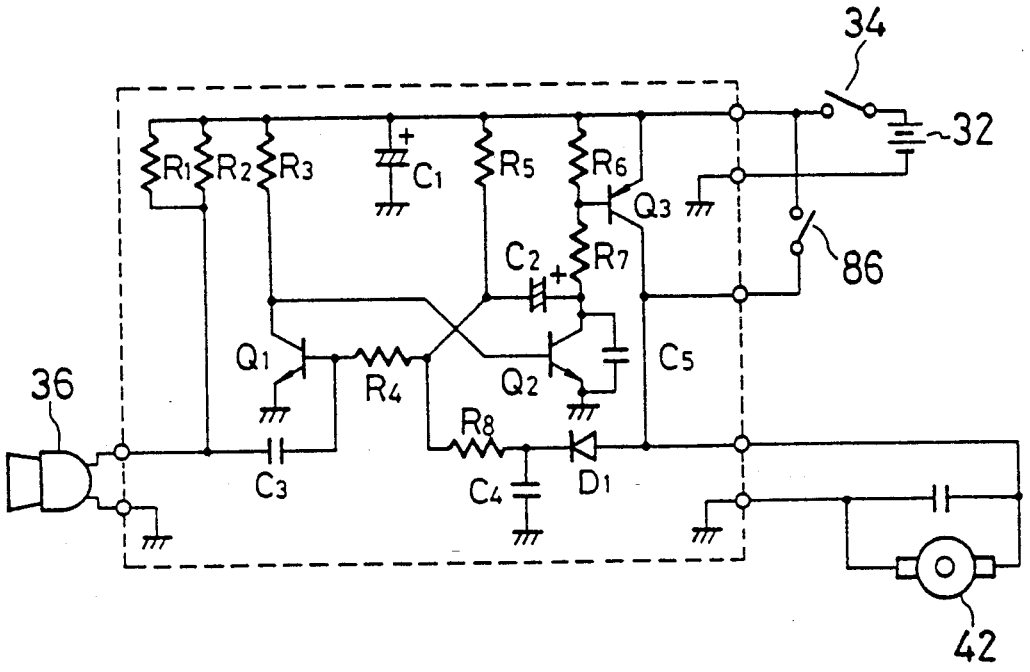
FIG. 13 is a circuit diagram showing a further motor drive circuit suitable for use for a figure moving article according to the present invention.

The motor drive circuit may be constructed in such a manner as shown in FIG. 13. In the motor drive circuit shown in FIG. 13, a posture detecting switch 86 is adapted to be turned off when the figure moving article is in an erect posture. When a sensor or microphone 36 detects sound of a predetermined level or more while a main switch 34 is kept closed, the figure moving article is in an erect posture and the posture detecting switch is open; a transistor $Q_3$ is turned on to drive a motor 42, resulting in the figure moving article carrying out a bending motion. The article continues the motion so far as the sound is successively detected. When the figure moving article is in a bent posture even if the sensor 36 does not detect sound, the posture detecting switch 86 is kept turned on, so that the figure moving article continues the bending motion until it reaches the erect posture. When the figure moving article reaches the erect posture, the posture detecting switch 86 is turned off to interrupt the bending movement of the article.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A battery operated movable novelty device capable of simulating the appearance of a hand-held can container for the storage of a beverage comprising:

an upper lid member providing a circular configuration;

a lower lid member providing a circular configuration;

a battery member positioned adjacent the lower lid member;

a motor assembly mounted on the lower lid member and operatively connected to the battery member;

a flexible material cylindrical casing, shaped to simulate the container, the casing being attached to, respectively, the upper and lower lid members and enclosing the motor assembly and battery member;

means for positioning the upper and lower lid members a spaced distance away from each other to cause the flexible cylindrical casing to be capable of assuming an approximately cylindrical shape; and means, connected to the motor assembly, for relatively moving the upper and lower lid members to cause the flexible casing to be deformed from and returned to a cylindrical shape during a cycle of movement, whereby the novelty device appearance can amuse an observer by apparently deviating from its normally stationary solid configuration and returning to that configuration.

2. The novelty device of claim 1 further including means for sensing sound to enable an operation of the motor assembly in response to the sound.

3. The novelty device of claim 1 wherein the means for moving includes an upper rigid support assembly that can pivotally move the upper lid member relative to the lower lid member.

4. The novelty device of claim 3 wherein the moving means includes a coiled spring to bias the upper lid member away from the lower lid member.

5. The novelty device of claim 1 further including a simulated configuration of sunglasses connected adjacent the upper lid member and extending across one side of the flexible material cylindrical casing and a simulated configuration of audio headphones connected adjacent the upper lid member and extending across the upper lid member to suggest a life-like humanoid characteristic.

6. The novelty device of claim 5 wherein the lower lid member has a compartment for receiving the battery member and the motor assembly is mounted above the compartment.

7. A self-contained novelty device for simulating a beverage can, comprising:

an upper relatively rigid lid member;

a lower relatively rigid lid member;

a source of power mounted on the lower lid member;

a flexible, cylindrically shaped material attached, respectively, about its perimeter edges to the upper and lower lid members and extending between them;

a motor assembly mounted within the flexible cylindrical material; and transmission means connected to the motor assembly and operable to move the upper lid member relative to the lower lid member to cause the cylindrically shaped material to be deformed from and returned to a cylindrical shape, the transmission means causing relative movement of the upper and lower lid members both towards and away from each other.

8. The novelty device of claim 7 further including a simulated configuration of sunglasses connected adjacent the upper lid member and extending across one side of the flexible cylindrical casing material and a simulated configuration of audio headphones connected adjacent the upper lid member and extending across the upper lid member.

9. A battery operated movable novelty device capable of simulating the appearance of a hand-held can container for the storage of a beverage, comprising:

an upper lid member;

a lower lid member;

battery means positioned on the lower lid member for providing a source of electrical power;

a motor assembly mounted on the lower lid member and operatively connected to the battery means;

a flexible cylindrical casing material, shaped to simulate the container, the casing material being attached to, respectively, the upper and lower lid members and enclosing the motor assembly and battery means;

transmission means connected to the motor assembly and operable to move the upper lid member relative to the lower lid member to cause the cylindrical casing material to be deformed from and returned to a cylindrical can shape;

a simulated configuration of sunglasses connected adjacent the upper lid member and extending across one side of the flexible cylindrical casing material; and a simulated configuration of audio headphones connected adjacent the upper lid member and extending across the upper lid member.

* * * * *